United States Patent [19]

McMillan

[11] Patent Number: 4,474,038

[45] Date of Patent: Oct. 2, 1984

[54] DRIVE SYSTEM FOR AUTOMATIC CLOTHES WASHING MACHINE

[75] Inventor: Stephen L. McMillan, Louisville, Ky.

[73] Assignee: General Electric Company, Louisville, Ky.

[21] Appl. No.: 540,435

[22] Filed: Oct. 11, 1983

[51] Int. Cl.[3] ..... D06F 23/04

[52] U.S. Cl. ..... 68/23 R; 68/208

[58] Field of Search ..... 68/23 R, 208; 74/425, 74/411.5, 421 A

[56] References Cited

U.S. PATENT DOCUMENTS

| | | | |
|---|---|---|---|
| 2,038,731 | 4/1936 | Gunderson | 74/425 |
| 2,089,934 | 8/1937 | Dunham | 74/606 |
| 2,135,084 | 11/1938 | Kirby | 74/425 X |
| 2,298,905 | 10/1942 | Skinner | 68/23 R X |
| 2,441,053 | 5/1948 | Wooster | 68/23 R |
| 2,494,436 | 1/1950 | Gerhardt | 68/23 |
| 2,563,046 | 8/1951 | Killin | 68/23 R |
| 2,720,953 | 10/1955 | Dayton | 68/23 R UX |
| 2,728,428 | 12/1955 | Cohen | 68/23 R UX |
| 2,837,927 | 6/1958 | Stelljes et al. | 68/23 R UX |
| 2,868,031 | 1/1959 | Schumb | 74/425 |
| 2,976,746 | 3/1961 | Flannery | 74/665 |
| 3,088,043 | 4/1963 | Graham | 310/76 |
| 4,217,788 | 8/1980 | Burr et al. | 74/425 |
| 4,317,343 | 3/1982 | Gerry | 68/23.7 |
| 4,329,630 | 5/1982 | Park | 318/258 |

FOREIGN PATENT DOCUMENTS

| | | | |
|---|---|---|---|
| 536383 | 12/1955 | Italy | 68/23 R |
| 998001 | 7/1965 | United Kingdom | 74/425 |

*Primary Examiner*—Philip R. Coe

*Assistant Examiner*—Frankie L. Stinson

*Attorney, Agent, or Firm*—Frank P. Giacalone; Radford M. Reams

[57] ABSTRACT

A clothes washing machine wherein the clothes receiving basket is driven through a speed reduction transmission by an electronically commutated motor operable unidirectionally in one mode for rotating the basket to effect a spin extraction cycle, and in a second mode motor rotation is cyclically reversed to cause oscillation of the basket during the washing operation. The speed reduction transmission is adapted to counteract the inertia of the basket generated by the high speed extraction cycle to provide a secondary braking action of the basket which supplements the dynamic braking capacity of the motor.

4 Claims, 1 Drawing Figure

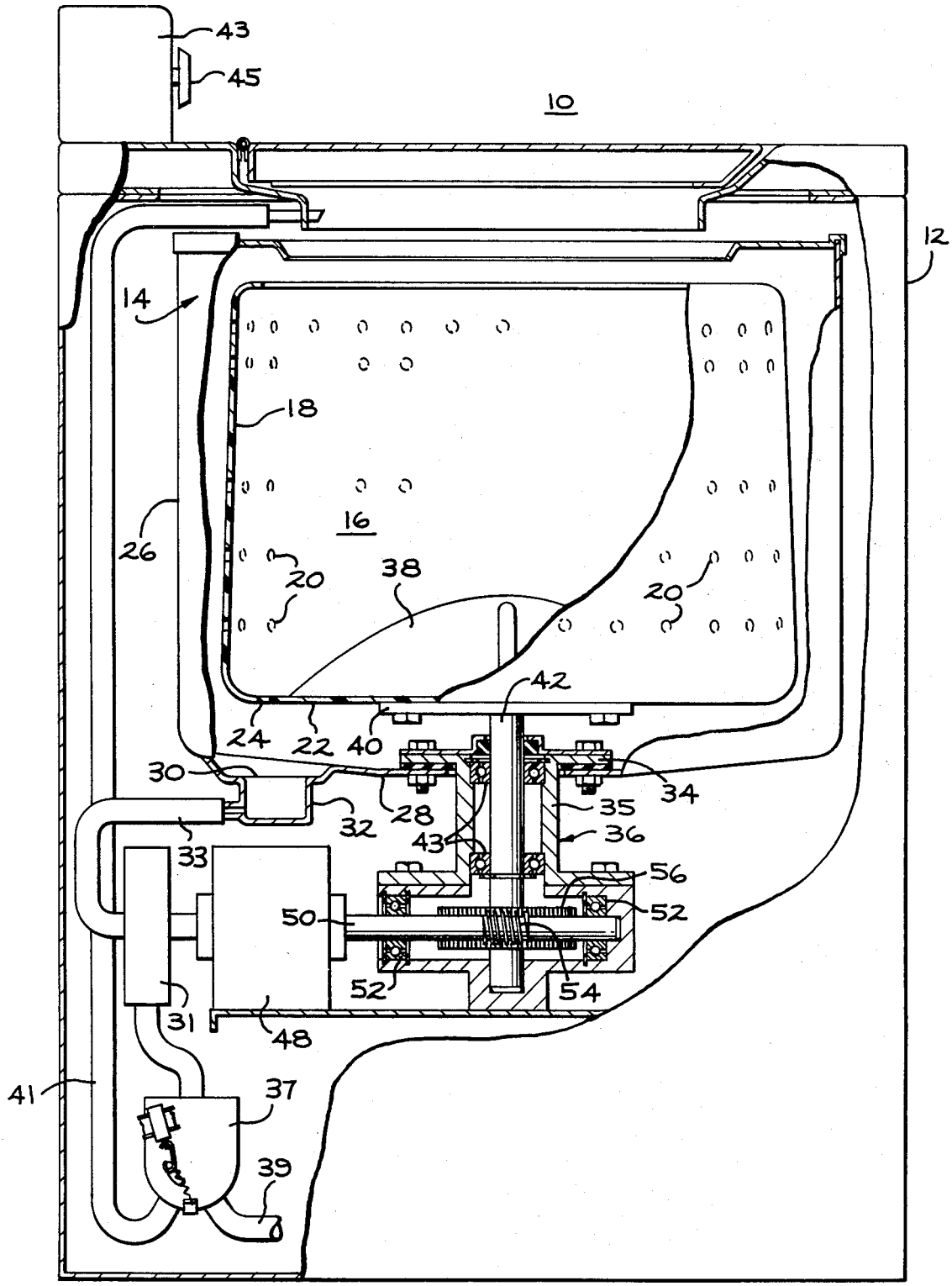
43
45
10
12
14
18
16
26
20
38
20
42
24
22
40
30
34
28
35
32
36
43
33
56
50
52
52
54
31
48
41
37
39

DRIVE SYSTEM FOR AUTOMATIC CLOTHES WASHING MACHINE

BACKGROUND OF THE INVENTION

The present invention relates to clothes washing machines and more particularly to a washing machine driven by a DC electronically commutated motor (ECM), for example, of the type disclosed in U.S. Pat. No. 4,329,630 assigned to the General Electric Company, the assignee of the present invention.

Motors of this type are bi-directional, capable of producing relatively slow oscillation of the agitator during the wash cycle with the motor being cyclically reversed and relatively high speed unidirectional spinning of the basket during an extraction cycle. Both types of motions are implemented by means of appropriate control of the voltage and current applied to the winding of the motor. At the end of each direction of rotation, the motor is electronically braked to terminate basket rotation. The dynamic braking of the motor is acting, in effect, against the velocity and inertia generated by the mass of the high speed spinning of the basket.

During the washing operation, when the motor is cyclically reversed the inertia of the basket is not a significant factor in the electronic braking of the motor between oscillatory directions. During the high speed unidirectional spin extraction cycle, the basket is rotated at speeds of approximately 600 RPM. At this speed the inertia generated by the mass of the high speed spinning basket may place too much resistance to the dynamic braking capability of the electronically commutated motor.

In prior art machines employing conventional motors, the spin extraction cycle is terminated by de-energizing the motor, at which time the basket mass wants to continue to rotate as a result of its inertia. Since access to the basket while it is still rotating presents a danger to the consumer, it is imperative that rotation of the basket stop at the time the motor is de-energized. It has been customary to provide some form of mechanical braking to accomplish adequate braking. This generally requires a special braking mechanism in addition to the motor and transmission which adds to the overall cost and complexity of the machine.

By the present invention, the size and design of the electronically commutated motor are selected to accomplish the braking of the basket under most operating conditions. However, means are provided to assist and supplement motor braking under all operating conditions.

SUMMARY OF THE INVENTION

Accordingly, it is an object of the invention to provide a minimum cost, low weight, speed reduction transmission adapted to assist the dynamic braking of an electronically commutated motor.

The present invention relates to a drive arrangement for a clothes washing machine having an outer tub and a clothes receiving basket mounted within the tub. The basket is driven by a drive member that rotatably supports the basket for high speed rotation during a spin extraction cycle and a relatively low rotational speed oscillation to cause washing action of the clothes disposed in the basket. The drive arrangement includes an electronically commutated drive motor operable in a first mode wherein the motor drive shaft is rotated unidirectionally to effect the spin extraction cycle of the basket and in a second mode wherein the drive shaft rotation is cyclically reversed to cause oscillation of the basket.

Transmission means are provided for counteracting the inertia of the basket generated by the high speed extraction cycle. The transmission means includes a housing which rotatably supports the drive motor shaft and the basket drive member. A reduction drive means includes an input worm secured to the output drive means and drivingly engages a worm-wheel secured to the basket drive member, wherein oscillation of the basket is achieved by driving the drive motor in the second mode, and high speed unidirectional rotation of the basket is achieved by driving said drive motor in the first mode whereby the dynamic braking of the motor at the termination of the high speed extraction cycle causes the frictional engagement between the worm-wheel and the worm to result in a secondary braking action of the basket which counteracts the inertia of the high speed rotation of the basket to supplement the dynamic braking capacity of the motor.

BRIEF DESCRIPTION OF THE DRAWING

The single FIGURE is a side elevational view of a clothes washing machine which includes the present invention, the view being partially broken away and partially in section to illustrate details.

DESCRIPTION OF THE PREFERRED EMBODIMENT

Referring now to the drawing, there is shown a vertical axis clothes washing machine 10 which includes a cabinet 12. Within the cabinet 12 is disposed an imperforate stationary outer tub 14. Within the imperforate tub 14 there is disposed a basket or receptacle 16 for receiving fabric articles, such as clothing, to be washed during a washing operation. The basket side wall 18 includes a plurality of apertures 20 for discharge of water during a centrifugal extraction or fast spinning portion of the operating cycle of the machine. The bottom wall 22 of the basket 16 is provided with openings 24 which serve to discharge particles, such as sand, from the water. The tub 14 is comprised of an imperforate side wall 26 and a generally imperforate and substantially horizontally disposed bottom wall 28 having a single drain opening 30 formed in a sump portion 32. The sump 32 is coupled to a suitable drain system through a centrifugal pump 31 driven by a bi-directional motor 48 and a conduit 33. The pump 31 is coupled to a three-way valve 37 which may be positioned for directing water to a drain conduit 39 leading to the drain system during the extraction cycle or to a conduit 41 for recirculating water through the basket during the washing cycle. The use of a centrifugal pump allows pumping of liquid toward the valve 37 regardless of direction of motor rotation. As a result, the flow of liquid in conduit 41 will be pulsating during rotation of the motor 48 in the washing operation. This pulsating flow is effective in recirculating water through the filter (not shown) and basket 16. The tub 14 is mounted on a flange portion 34 of a housing 35 defining the speed reduction drive transmission 36 whose function forms a part of the present invention and will be explained fully hereinafter. At the center of the basket 16 there is positioned an agitator 38 mounted for rotation with the basket 16. The basket 16 is supported on a flange 40 which has secured thereto the upper end of a drive shaft 42. The lower end of the basket drive shaft 42 is rotatably supported in the transmission housing 35 by suitable bearings 43.

Other conventional elements, such as a water supply system for providing hot and cold water to the machine and a water level control arrangement for providing a predetermined amount of water of a proper temperature, may be provided to the machine. Such elements are well known in the art and do not form a part of the present invention. They have, therefore, been omitted from the drawing for ease of illustration. A control panel 43 may have suitable manually operable members such as that shown at 45. The member 45 may be used to control, for instance, water temperature, water level within tub 14 and basket 16, etc., and for initiating a cycle of operation of the machine.

In accordance with the present invention the drive mechanism includes the bi-directional motor 48 and the speed reduction transmission 36 referred to above. The bi-directional motor 48 is of the type capable of producing relatively slow oscillation of the agitator 38 and integral basket 16 during the wash cycle, and relatively high speed unidirectional spinning of the agitator 38 and basket 16 during a spin-out liquid extraction cycle. Both types of motion are implemented by means of appropriate control of voltage and current applied to the windings of the motor 48. Insofar as the present invention is concerned, a wide variety of DC motors may be employed, either shunt or permanent magnet field. Preferably, the DC motor 48 is a disc-type electronically commutated motor (ECM), eliminating the need for mechanically contacting brushes. The type motor which may be employed in carrying out the present invention is fully disclosed in the abovementioned U.S. Pat. No. 4,329,630-Park, which is accordingly incorporated herein by reference.

The motor is connected to a drive shaft 50 which extends into the transmission housing 35. The shaft 50 is rotatably supported by suitable bearings 52 journalled in the housing 35. The transmission consists of a worm 54 secured to the motor drive shaft 50 and a worm wheel 56 secured to the basket drive shaft 42.

In operation during the washing operation the motor 48 is cyclically reversed to cause low speed oscillation of the agitator and basket to impart a washing action to the clothes. The exact position or time of braking of the basket between each reverse rotation of the motor is not critical. Because of the relative slow speed of oscillation during the time the basket is cyclically reversed, the inertia of the moving basket causes a relatively small torque and the dynamic braking of the motor at the end of each direction of rotation is acceptable. In operation of the machine during the high speed extraction cycle the motor 48, in combination with the mechanical transmission system, provides a higher speed (for example, 600 RPM) unidirectional rotation. At this relatively high speed the inertia of the rotating means creates a motion which is difficult to stop within an acceptable time period. At the termination of the extraction cycle, the motor 48 is electronically braked to terminate basket rotation. The employment of a speed reduction coupling in the form of the worm 54 and worm-wheel 56 between the motor and basket provides a secondary braking action which supplements the braking action of the motor when applied to the basket. In effect, the energy of the rotating mass is converted to frictional energy in the transmission through the inability of the worm-wheel 56 secured to the basket drive shaft 40 to drive the worm 54 secured to the motor drive shaft 50. As the motor is dynamically braked and slows down, kinetic energy of the basket is dissipated into the transmission worm-wheel and worm to supplement the dynamic braking force of the motor.

It should be apparent to those skilled in the art that the embodiment described heretofore is considered to be the presently preferred form of this invention. In accordance with the Patent Statutes, changes may be made in the disclosed apparatus and the manner in which it is used without actually departing from the true spirit and scope of this invention.

What is claimed is:

1. A drive arrangement for a clothes washing machine having a clothes receiving basket, a basket drive member rotatably supporting said basket for high speed rotation of the basket during a spin extraction cycle and a relatively low rotational speed oscillation of said basket to cause washing action of said clothes disposed in said basket, the drive arrangement comprising:

drive motor means including an electronically commutated drive motor adapted to be electronically braked including an output drive means, drive shaft, said drive motor operable in first and second drive modes, wherein in said first mode, said drive shaft is rotated unidirectionally to effect said spin extraction cycle of said basket and in said second mode, said drive shaft rotation is cyclically reversed to cause oscillation of said basket;

transmission means counteracting the inertia of said basket generated by said extraction cycle including a housing means rotatably supporting said drive motor shaft and said basket drive member, a reduction drive means including an input worm secured to said output drive means, drivingly engaging a worm-wheel secured to said basket drive member, wherein oscillation of said basket is achieved by driving said drive motor in said second mode, and high speed unidirectional rotation of said basket is achieved by driving said drive motor in said first mode;

whereby the dynamic braking of said motor at the termination. of said high speed extraction cycle causes the frictional engagement between said worm-wheel and said worm to result in a secondary braking action of said basket which counteracts the inertia of the high speed rotation of the basket to supplement the dynamic braking capacity of said motor.

2. A drive arrangement for a clothes washing machine recited in claim 1 wherein said washing machine is of the vertical axis type, said basket drive member extending vertically into said transmission means, and said output drive means extending horizontally into said transmission means.

3. A drive arrangement for a clothes washing machine recited in claim 2 further including an imperforate outer tub with said basket being rotatably mounted within said tub.

4. A drive arrangement for a clothes washing machine recited in claim 3 further including a drain system including a centrifugal pump and a three-way valve arrangement for directing water from said basket toward said three-way valve in both said first and second drive modes whereby in said first drive mode said valve is operable to direct water to a drain and in said second drive mode said valve is operable to direct water to said basket for recirculating said water.

* * * * *